US010317127B2

(12) United States Patent
Besore et al.

(10) Patent No.: US 10,317,127 B2
(45) Date of Patent: Jun. 11, 2019

(54) REFRIGERATOR APPLIANCES INCLUDING A DRAWER ASSEMBLY

(71) Applicant: Haier US Appliance Solutions, Inc., Wilmington, DE (US)

(72) Inventors: John Keith Besore, Prospect, KY (US); Brent Alden Junge, Evansville, IN (US); Lauren Nicole Platts, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/716,589

(22) Filed: Sep. 27, 2017

(65) Prior Publication Data

US 2019/0093940 A1 Mar. 28, 2019

(51) Int. Cl.

| | |
|---|---|
| ***F25D 23/02*** | (2006.01) |
| ***F25D 11/02*** | (2006.01) |
| ***F25D 25/02*** | (2006.01) |
| *F25D 23/12* | (2006.01) |
| *F25D 23/04* | (2006.01) |

(52) U.S. Cl.

CPC ..... *F25D 23/028* (2013.01); *F25D 25/025* (2013.01); *F25D 11/02* (2013.01); *F25D 23/04* (2013.01); *F25D 23/12* (2013.01)

(58) Field of Classification Search

CPC ..... F25D 23/028; F25D 23/04; F25D 25/015; F25D 23/02; F25D 23/025; F25D 23/12; F25D 25/025; F25D 11/02

See application file for complete search history.

(56) References Cited

U.S. PATENT DOCUMENTS

| | | | | |
|---|---|---|---|---|
| 8,172,346 | B2 | 5/2012 | Tafoya et al. | |
| 9,074,810 | B2 * | 7/2015 | Hwang | F25D 23/02 |
| 9,322,474 | B2 | 4/2016 | Lee et al. | |
| 10,088,224 | B1 * | 10/2018 | Platts | F25D 25/025 |
| 2010/0090575 | A1 * | 4/2010 | Uthuppan | F25D 23/04 312/404 |
| 2011/0210655 | A1 * | 9/2011 | Brown | F25D 25/025 312/334.8 |
| 2012/0042670 | A1 * | 2/2012 | Lee | F25D 25/025 62/125 |
| 2012/0060544 | A1 * | 3/2012 | Lee | F25D 23/02 62/440 |
| 2012/0099255 | A1 * | 4/2012 | Lee | F25D 25/025 361/679.01 |
| 2012/0181910 | A1 * | 7/2012 | Kim | F25D 23/02 312/404 |
| 2015/0115790 | A1 * | 4/2015 | Ogg | F25D 23/069 312/404 |

(Continued)

FOREIGN PATENT DOCUMENTS

| | | | |
|---|---|---|---|
| EP | 2325583 | A1 | 5/2011 |
| WO | WO2012069439 | A2 | 5/2012 |

*Primary Examiner* — Kimberley S Wright

(74) *Attorney, Agent, or Firm* — Dority & Manning, P.A.

(57) ABSTRACT

A refrigerator appliance including a drawer assembly is included herein. The refrigerator appliance may include a cabinet defining a chilled chamber, as well as a door attached to the cabinet movable between a closed position and an open position. The drawer assembly may be disposed within the chilled chamber. Moreover, the drawer assembly may include a drawer frame and a forward panel, as described herein.

19 Claims, 11 Drawing Sheets

(56) References Cited

U.S. PATENT DOCUMENTS

| | | | | |
|---|---|---|---|---|
| 2015/0241119 | A1* | 8/2015 | Sankhgond | F25D 25/025 312/114 |
| 2016/0265837 | A1* | 9/2016 | Bhatt | F25D 25/025 |
| 2017/0059237 | A1* | 3/2017 | Anderson | F25D 29/005 |
| 2017/0122653 | A1* | 5/2017 | Cizik | F25D 17/06 |
| 2017/0160002 | A1* | 6/2017 | Kang | F25D 25/025 |
| 2017/0292756 | A1* | 10/2017 | Fenko | F25D 3/08 |
| 2017/0307285 | A1* | 10/2017 | Cizik | F25D 25/025 |
| 2017/0321958 | A1* | 11/2017 | Ramm | F25D 25/025 |
| 2018/0017315 | A1* | 1/2018 | Choi | F25D 23/00 |
| 2018/0038630 | A1* | 2/2018 | Biotti | F25D 11/02 |

* cited by examiner

REFRIGERATOR APPLIANCES INCLUDING A DRAWER ASSEMBLY

FIELD OF THE INVENTION

The present subject matter relates generally to refrigerator appliances and more particularly to refrigerator appliances including one or more drawer assemblies.

BACKGROUND OF THE INVENTION

Certain refrigerator appliances utilize sealed systems for cooling chilled chambers of the refrigerator appliances. A typical sealed system includes an evaporator and a fan, the fan generating a flow of air across the evaporator and cooling the flow of air. The cooled air is then provided through an opening into the chilled chamber to maintain the chilled chamber at a desired temperature. Air from the chilled chamber is circulated back through a return duct to be re-cooled by the sealed system during operation of the refrigerator appliance, maintaining the chilled chamber at the desired temperature.

Certain refrigerators appliances also include one or more fresh food and/or freezer chambers configured for maintaining different temperatures for storing different types of food and drink. For example, a conventional refrigerator appliance may be formed as a side-by-side configuration wherein a fresh food chamber is positioned beside a freezer chamber. Both the fresh food chamber and the freezer chamber will generally extend from the top of the refrigerator appliance to the bottom of the refrigerator appliance. As another example, a conventional refrigerator appliance may be formed as a bottom-mount refrigerator appliance wherein a freezer chamber is positioned below a fresh food chamber.

However, problems exist with conventional refrigerator appliances. In the case of side-by-side refrigerator appliances, usable space is generally limited by the width of the chambers. In other words, a user may be unable to place certain objects within the refrigerator since the width of both the fresh food chamber and the chilled chamber is necessarily limited by the width of the other chamber. In the case of a bottom mount refrigerator appliance, it may be difficult to organize and/or access certain items. Small items, as an example, may fall to the bottom of the freezer chamber, where they may become lost or inaccessible. Moreover, since the freezer chamber must be viewed from above, it may be difficult for a user to easily determine what articles are items are within the freezer chamber. If a drawer assembly is used within a conventional refrigerator appliance, usable space (e.g., the depth of a drawer from front to back) may be further limited by the need to create a seal between a door of the refrigerator and the refrigerator cabinet.

In turn, further improvements for refrigerator appliances would be beneficial. For instance, it would be beneficial to have a refrigerator appliance addressing one or more of the above issues. Moreover, it may be beneficial to have a refrigerator appliance with one or more features for readily storing and viewing a broad range of articles at various chilled temperatures within a cabinet of the refrigerator appliance.

BRIEF DESCRIPTION OF THE INVENTION

Aspects and advantages of the invention will be set forth in part in the following description, or may be obvious from the description, or may be learned through practice of the invention.

In one aspect of the present disclosure, a refrigerator appliance is provided. The refrigerator appliance may include a cabinet, a door, and a drawer assembly. The cabinet may define a chilled chamber extending along a lateral direction between a first side portion and a second side portion. The door attached to the cabinet movable between a closed position restricting access the chilled chamber and an open position permitting access to the chilled chamber. The drawer assembly may be disposed within the chilled chamber. The drawer assembly may include a drawer frame, a forward panel, a first sliding segment, and a second sliding segment. The drawer frame may be slidable along a transverse direction. The drawer frame may extend in the lateral direction between a first lateral side and a second lateral side. The drawer frame may extend along the transverse direction between a front side and a rear side. The forward panel may be attached to the drawer frame at the front side. The forward panel may extend along the lateral direction between the first lateral side and the second lateral side. The first sliding segment may be attached to the drawer frame proximal to the first lateral side. The first sliding segment may be independently slidable relative to the drawer frame along the transverse direction. The second sliding segment may be attached to the drawer frame proximal to the second lateral side. The second sliding segment may be independently slidable relative to the drawer frame and the first sliding segment along the transverse direction.

In another aspect of the present disclosure, a refrigerator appliance is provided. The refrigerator appliance may include a cabinet, a first door, a second door, and a drawer assembly. The cabinet may define a chilled chamber. The chilled chamber may extend along a lateral direction between a first side portion and a second side portion. The chilled chamber may extend along a vertical direction between an upper portion and a bottom portion. The first door may be rotatably attached to the cabinet at the first side portion and movable between a closed position restricting access to a first portion of the chilled chamber and an open position permitting access to the first portion of the chilled chamber. The first door may include a vertical gasket segment. The second door may be rotatably attached to the cabinet at the second side portion and movable between a closed position restricting access to a second portion of the chilled chamber and an open position permitting access to the second portion of the chilled chamber. The second door may include a vertical gasket segment. The drawer assembly may be disposed within the chilled chamber. The drawer assembly may include a drawer frame and a forward panel. The drawer frame may be slidable along the transverse direction and extend in the lateral direction between the first portion of the chilled chamber to the second portion of the chilled chamber. The drawer frame may further extend along the transverse direction between a front side and a rear side. The forward panel may be attached to the drawer frame at the front side and extend along the vertical direction between the upper portion and the bottom portion. The forward panel may be sealingly engaged with the vertical gasket segment of the first door at the closed position of the first door. The forward panel may be sealingly engaged with the vertical gasket segment of the second door at the closed position of the second door.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
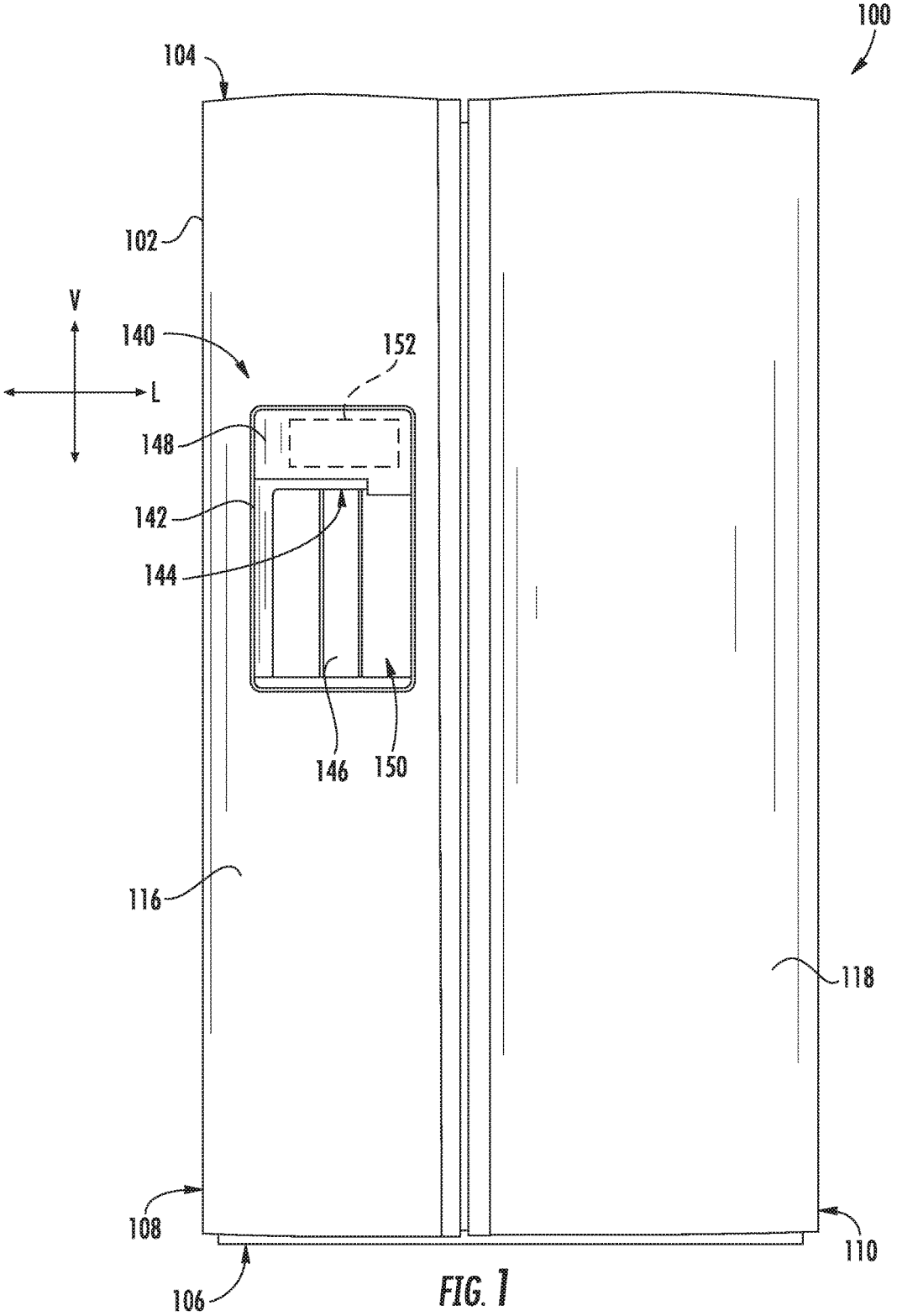
FIG. 1 provides a front view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components.

Figure 2:
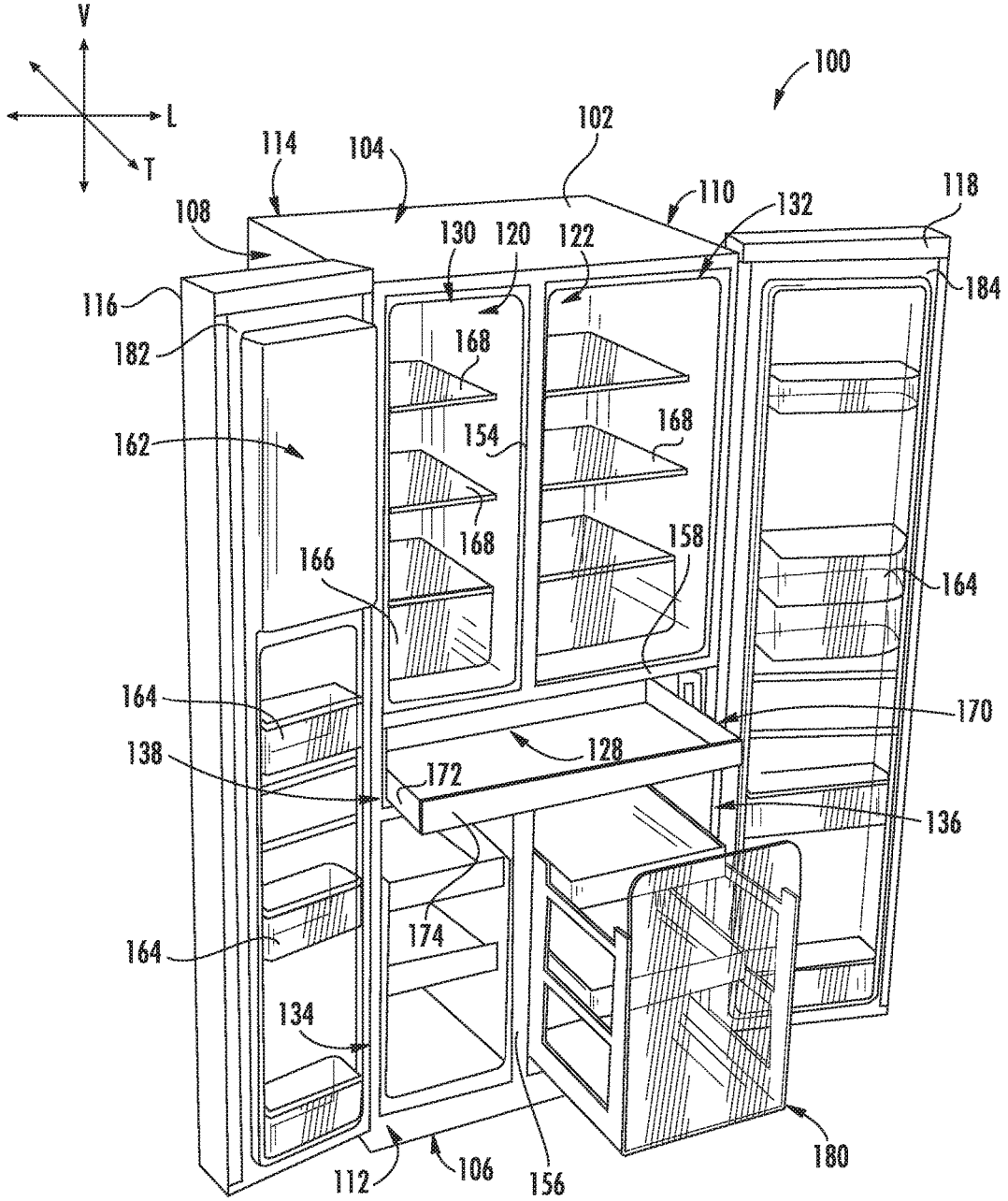
FIG. 2 provides a perspective view of the exemplary refrigerator appliance of FIG. 1 with the refrigerator doors shown in an open position.
Figure 3:
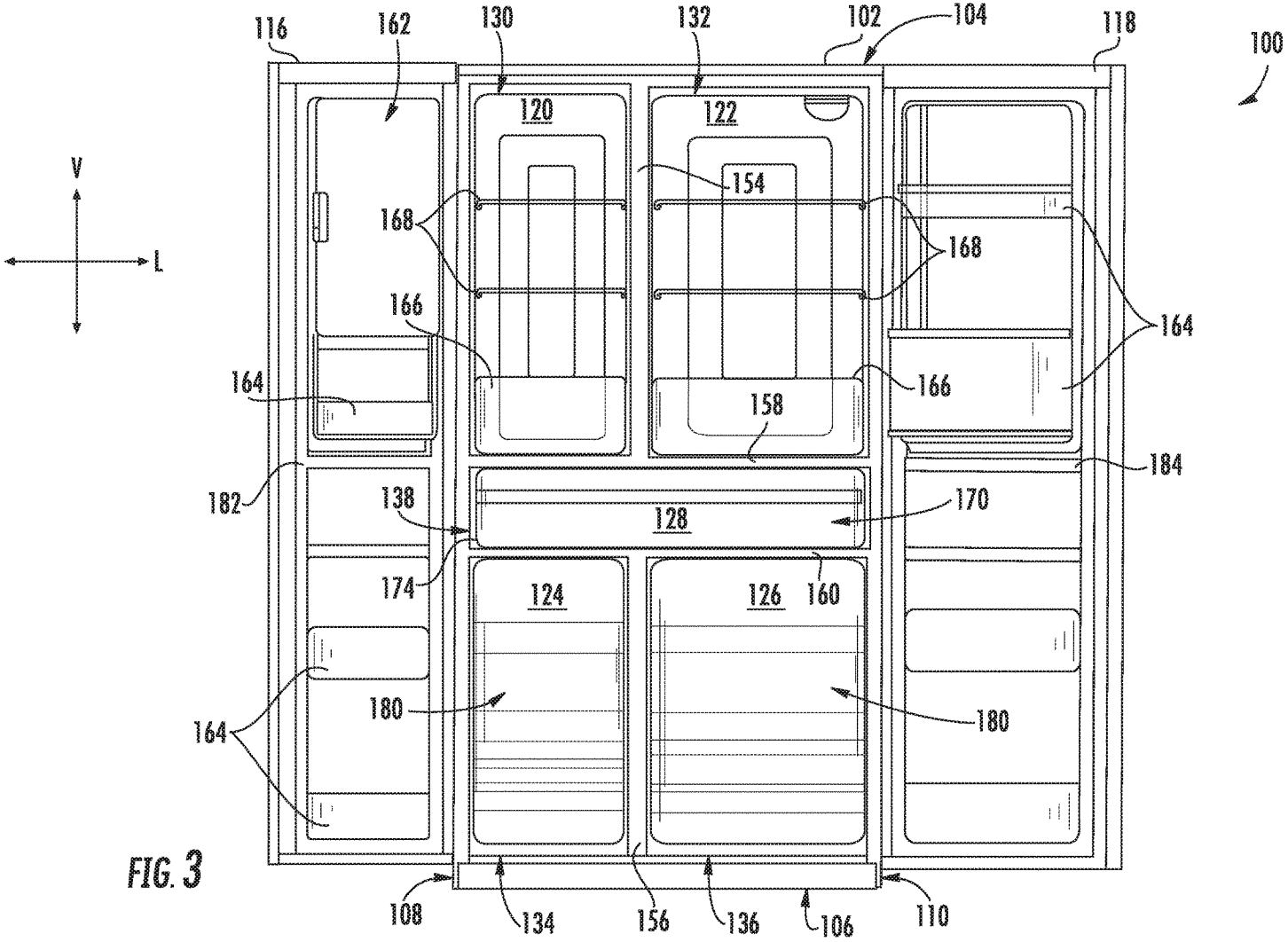
FIG. 3 provides a front view of the exemplary refrigerator appliance of FIG. 1 with the refrigerator doors shown in an open position.

Turning now to the figures, FIGS. 1 through 3 provide multiple views of a refrigerator appliance 100 according to exemplary embodiments of the present disclosure. FIG. 1 provides a front view of refrigerator appliance 100. FIG. 2 provides a perspective view of refrigerator appliance 100 with multiple doors 116, 118 shown in an open position. FIG. 3 provides a front view of refrigerator appliance 100 with doors 116, 118 shown in the open position.

Refrigerator appliance 100 generally includes a housing or cabinet 102 that extends between an upper portion 104 and a lower portion 106 along a vertical direction V, between a first external side portion 108 and a second external side portion 110 along a lateral direction L, and between a front portion 112 and a rear portion 114 along a transverse direction T. Each of the vertical direction V, lateral direction L, and transverse direction T are mutually perpendicular to one another.

Cabinet 102 defines a plurality of chilled chambers 120, 122, 124, 126, 128 (e.g., fresh food chambers and/or freezer chambers) for receipt of food items for storage. In some embodiments, cabinet 102 defines multiple discrete upper chambers 120, 122 and lower chambers 124, 126. For example, one or more upper chambers 120, 122 (e.g., a first and a second chilled chamber) may be positioned above one or more lower chambers 124, 126 (e.g., a third and a fourth chilled chamber). In certain embodiments, one upper chamber 120 is positioned at (e.g., proximal to) the first side portion 108 of the cabinet 102, while another upper chamber 122 is positioned at (e.g., proximal to) the second side portion 110. In further embodiments, one lower chamber 124 is positioned at (e.g., proximal to) the first side portion 108 beneath the upper chamber 120, while another lower chamber 126 is positioned at (e.g., proximal to) the second side portion 110 beneath the upper chamber 122.

In some embodiments, an intermediate chamber 128 (e.g., full width chamber) is positioned between the one or more upper chambers 120, 122 and the one or more lower chambers 124, 126. In turn, each lower chamber 124, 126 may be positioned directly beneath intermediate chamber 128 while each upper chamber 120, 122 is positioned directly above intermediate chamber 128. As shown, intermediate chamber 128 may extend between the first side portion 108 to the second side portion 110 to occupy the full internal width of cabinet 102 (e.g., such that intermediate chamber 128 has a lateral width equal to the combined lateral width of the upper chambers 120, 122 or lower chambers 124, 126).

Each chilled chamber 120, 122, 124, 126, 128 is generally accessible (e.g., to add or remove items within refrigerator appliance 100 along the transverse direction T) through a separate opening 130, 132, 134, 136, 138 at the front portion 112 of cabinet 102. Specifically, one upper opening 130 is in communication with (and permits access to) upper chamber 120; one upper opening 132 is in communication with (and permits access to) upper chamber 122; an intermediate opening 138 is in communication with (and permits access to) intermediate chamber 128; one lower opening 134 is in communication with (and permits access to) lower chamber 124; and one lower opening 136 is in communication with (and permits access to) lower chamber 126.

It is understood that each chamber 120, 122, 124, 126, 128 is generally separated by one or more mullions. For example, an upper vertical mullion 154 may separate upper chambers 120, 122 from each other. A lower vertical mullion 156 may separate lower chambers 124, 126 from each other. An upper horizontal mullion 158 may separate intermediate chamber 128 from the upper chambers 120, 122. A lower horizontal mullion 160 may separate intermediate chamber 128 from the lower chambers 124, 126. Each mullion 154, 156, 158, 160 may be formed from an insulating material, such as foam, and extend across an internal liner of the cabinet 102. In addition, to provide structural support, a rigid injection molded liner or a metal frame may surround the insulating foam of each mullion 154, 156, 158, 160 and further separate the chambers 120, 122, 124, 126, 128. In turn, each chamber 120, 122, 124, 126, 128 may be maintained at a unique temperature (e.g., between around 0° F. and 57° F.) by one or more sealed refrigeration systems (not pictured). As an example, upper chamber 120 and lower chamber 124 may each be maintained at unique freezer temperatures (e.g., between 0° F. and 32° F.). As an additional or alternative example, upper chamber 122 and lower chamber 126 may each be maintained at unique fresh food temperatures (e.g., between 32° F. and 57° F.).

Advantageously, upper chambers 120, 122 are provided at a comfortable and readily accessible height (e.g., such that most users will be able to view the entire height of upper chambers 120, 122 without bending over). Moreover, intermediate chamber 128 may be positioned at a typical waist-level position such that at least a portion of intermediate chamber 128 may advantageously be accessed without bending over.

Various doors may be mounted to cabinet 102 to selectively open and close a portion of the one or more chilled chambers 120, 122, 124, 126, 128. As an example, a pair of side-by-side French doors 116, 118 may, together, cover chilled chambers 120, 122, 124, 126, 128. In some embodiments, a first door 116 is rotatably attached to cabinet 102 at the first side portion 108. In other words, first door 116 is configured to rotate about a door axis proximal to first side portion 108, as illustrated. When assembled, first door 116 may selectively move between a closed position (FIG. 1) and an open position (FIGS. 2 and 3). The closed position of first door 116 generally restricts access to upper chamber 120 and lower chamber 124. Moreover, the closed position of first door 116 may restrict access to at least a portion (e.g., one half or less than one half) of intermediate chamber 128. In further embodiments, a second door 118 is rotatably attached to cabinet 102 at the second side portion 110. In other words, second door 118 is configured to rotate about a door axis proximal to second side portion 110, as illustrated. When assembled, second door 118 may selectively move between a closed position (FIG. 1) and an open position (FIGS. 2 and 3). The closed position of second door 118 generally restricts access to upper chamber 122 and lower chamber 126. Moreover, the closed position of second door 118 may restrict access to at least a portion (e.g., another half or more than one half) of intermediate chamber 128.

In order to prevent or restrict leakage of cool air, doors 116, 118 and/or cabinet 102 may include one or more sealing mechanisms at the interface where the doors 116, 118 meet cabinet 102. In some such embodiments, each door 116, 118 comprises a discrete perimeter gasket set (e.g., foam seal or rubber gasket) to sealingly engage the cabinet 102 in a closed position and isolate the corresponding chilled chamber(s) from the other chilled chambers. As an example, a first gasket set 182 may be mounted to an inner portion of first door 116 to isolate upper chamber 120, lower chamber 124, and/or a portion of intermediate chamber 128 in the closed position. Specifically, in the closed position, first gasket set 182 may form a continuous seal against a perimeter portion of cabinet 102 (e.g., at the first side portion 108), upper vertical mullion 154, upper horizontal mullion 158, lower horizontal mullion 160, and lower vertical mullion 156. Additionally or alternatively, a second gasket set 184 may be mounted to an inner portion of second door 118 to isolate upper chamber 122, lower chamber 126, and/or a portion of intermediate chamber 128 in the closed position. Specifically, in the closed position, second gasket set 184 may form a continuous seal against a perimeter portion of cabinet 102 (e.g., at the second side portion 110), upper vertical mullion 154, upper horizontal mullion 158, lower horizontal mullion 160, and lower vertical mullion 156.

In some embodiments, refrigerator appliance 100 also includes a dispensing assembly 140 for dispensing liquid water and/or ice (e.g., from an ice making assembly 162 mounted to door 116). Dispensing assembly 140 includes a dispenser 142 positioned on or mounted to an exterior portion of refrigerator appliance 100, e.g., on one of doors 116, 118. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs, such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is defined at a predetermined elevation convenient for a user to access ice or water and enabling the user to access ice without the need to bend-over and without the need to open doors 116, 118. In the exemplary embodiment, dispenser recess 150 is positioned at a level that approximates the chest level of a user.

Refrigerator appliance 100 further includes a controller 152. Operation of the refrigerator appliance 100 is generally regulated by controller 152. Controller 152 may be provided in communication (e.g., electrically coupled) with a panel. In exemplary embodiments, a control panel is included as general purpose I/O ("GPIO") device or functional block. In other exemplary embodiments, a control panel is included with multiple input components, such as one or more of a variety of electrical, mechanical or electro-mechanical input devices including rotary dials, push buttons, touch pads, and touch screens. The control panel may be in communication (e.g., electrically coupled) with controller 152 via one or more signal lines or shared communication busses.

Moreover, controller 152 may be in communication with a sealed refrigeration system (not pictured) directing cooling operations of refrigerator appliance 100. During use, controller 152 may initiate cooling operations (e.g., cooling airflows) within the various chilled chambers 120, 122, 124, 126, 128. Optionally, each chilled chamber 120, 122, 124, 126, 128 may be operably independent such that a discrete operating temperature may be selected for each chilled chamber 120, 122, 124, 126, 128. For instance, refrigerator appliance 100 is able to maintain one lower chamber 124, at a separate temperature from another lower chamber 126. Additionally or alternatively, upper chambers 120, 122 and intermediate chamber 128 may each be maintained at separate or unique temperatures from the other chilled chambers.

In some embodiments, controller 152 includes memory (e.g., non-transitive media) and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The memory can be a separate component from the processor or can be included onboard within the processor. Alternatively, controller 152 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

According to the illustrated embodiments, various storage components are mounted within upper chambers 120, 122 and lower chambers 124, 126 to facilitate storage of food items therein as will be understood by those skilled in the art. In particular, the storage components include bins 164, drawers 166, and shelves 168 that are mounted within upper chambers 120, 122 and/or lower chambers 124, 126. Bins 164, drawers 166, and shelves 168 are configured for receipt of food items (e.g., beverages and/or solid food items) and may assist with organizing such food items. A separate intermediate drawer assembly 170 may be mounted within intermediate chamber 128. Additionally or alternatively, one or both of lower chambers 124, 126 may have a separate bottom drawer assembly 180 mounted therein.

In some embodiments, intermediate drawer assembly 170, including an intermediate drawer 172, is slidably disposed within intermediate chamber 128. In other words, intermediate drawer assembly 170 may slide along the transverse direction T between a covered position (FIG. 3) and an uncovered position (FIG. 2). As illustrated, the covered position of intermediate drawer assembly 170 may generally provide intermediate drawer 172 within (e.g., enclosed by) intermediate chamber 128. Access to items within intermediate drawer 172, and intermediate chamber 128 generally, may be restricted in the covered position. By contrast, in the uncovered position, at least a portion of intermediate drawer 172 may extend from intermediate chamber 128, such that a user may advantageously view and/or access any items within intermediate drawer 172 and/or intermediate chamber 128 without bending over.

As illustrated in FIGS. 2 and 3, in certain embodiments, intermediate drawer 172 includes a forward wall or panel 174 positioned proximal to the intermediate opening 138 in the covered position of intermediate drawer assembly 170. In turn, when intermediate drawer 172 is in the covered position, forward panel 174 generally extends across intermediate opening 138, thereby restricting access to intermediate chamber 128.

Figure 4:
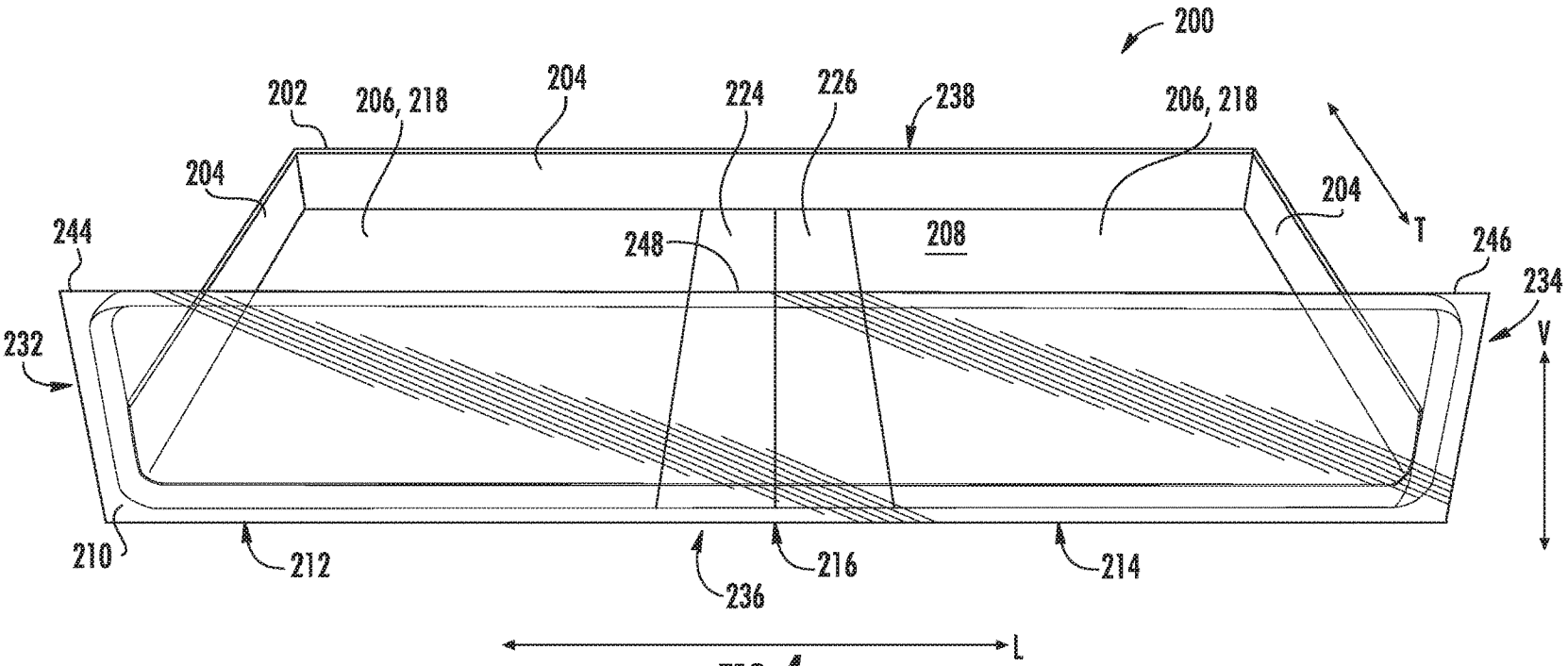
FIG. 4 provides a perspective top view of an intermediate drawer of a refrigerator appliance according to exemplary embodiments of the present disclosure.
Figure 5:
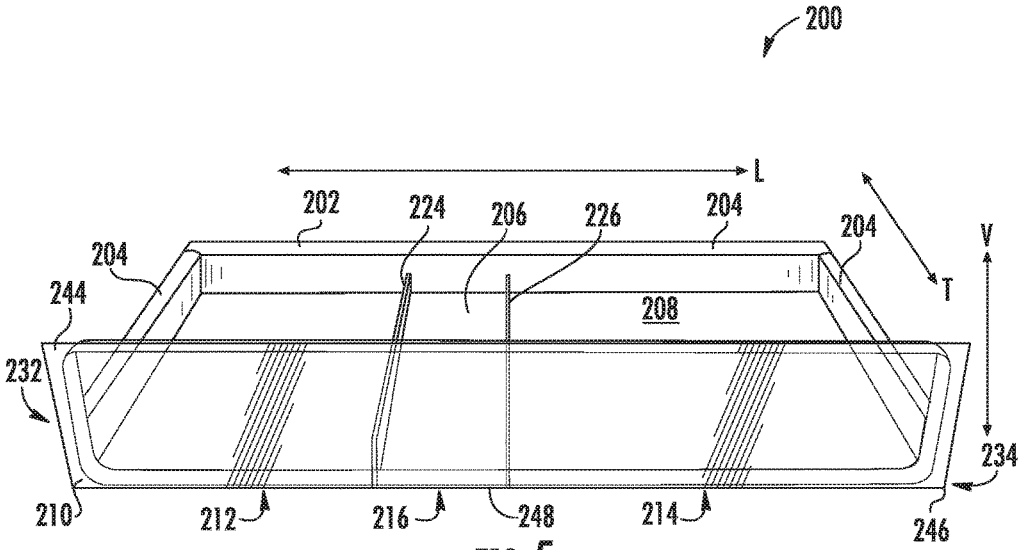
FIG. 5 provides a perspective top view of the exemplary intermediate drawer of FIG. 4 with a pair of partitions in an upright position.
Figure 6:
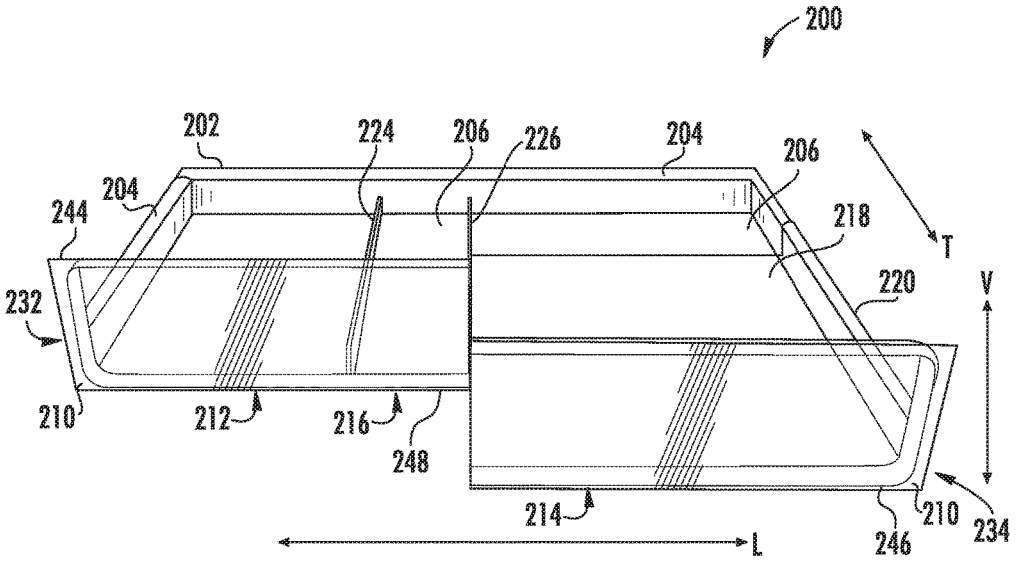
FIG. 6 provides a perspective top view of the exemplary intermediate drawer of FIG. 5 with a sliding segment in a forward position.

Turning now to FIGS. 4 through 6, an exemplary intermediate drawer 200 is illustrated for use within an intermediate drawer assembly 170 of refrigerator appliance 100 (FIGS. 1 through 3). It is understood that intermediate drawer 200 may be generally embodied as intermediate drawer 172, or as an alternative thereto.

As shown, intermediate drawer 200 includes a drawer frame 202 that extends in or along the lateral direction L between a first lateral side 232 and a second lateral side 234, as well as between a front side 236 and a rear side 238 along the transverse direction T. In some embodiments, a plurality of side panels 204 extends from a base panel 206 to define a storage volume 208. For instance, one side panel 204 may extend from the base panel 206 along the vertical direction V at the rear side 238. A pair of oppositely-disposed side panels 204 may extend from the base panel 206 along the vertical direction V at the first lateral side 232 and second lateral side 234, respectively.

In certain embodiments, a forward panel 210 is mounted to drawer frame 202 to further define storage volume 208. As shown, forward panel 210 may extend along the vertical direction V at a transverse extreme (e.g., at front side 236) of intermediate drawer 200. In some such embodiments, forward panel 210 may be formed as transparent member (e.g., from a transparent glass or plastic material). Generally, forward panel 210 may extend along the lateral direction L between first lateral side 232 and second lateral side 234. Additionally or alternatively, forward panel 210 may be formed to complement intermediate opening 138 (FIG. 2). In turn, forward panel 210 may extend across and/or in front of intermediate opening 138 in a covered position.

In optional embodiments, intermediate drawer 200 includes one or more sliding segments 212, 214, 216 that can slide independently of each other and/or another portion of drawer frame 202. For instance, a first sliding segment 212 and a second sliding segment 214 may be slidably mounted on base panel 206. As shown, first sliding segment 212 is attached to drawer frame 202 proximal to the first lateral side 232. Second sliding segment 214 is attached to drawer frame 202 proximal to the second lateral side 234. First sliding segment 212 and second sliding segment 214 may each include a secondary floor 218 fixed relative to a portion of forward panel 210 to slide in or along the transverse direction T relative to (e.g., on top of or below) base panel 206. For instance, one or more mated guide slot-rail joints 242 may be formed between base panel 206 and each secondary floor 218. Optionally, a secondary sidewall 220 may be further fixed relative to a portion of forward panel 210 to similarly slide in or along the transverse direction T relative to (e.g., on top of or below) a respective side panel 204.

When assembled within refrigerator appliance 100 (FIG. 3), it is understood that first sliding segment 212 may be positioned proximal to first side portion 108 (i.e., distal to second side portion 110) while second sliding segment 214 is positioned proximal to second side portion 110 (i.e., distal to first side portion 108). In some such embodiments, first sliding segment 212 is covered by first door 116 (FIG. 2) in its closed position while second sliding segment 214 is covered by second door 118 (FIG. 2) in its closed position. Advantageously, first and second sliding segment 212, 214 may be independently slidable relative to each other such that one sliding segment (e.g., first sliding segment 212) may selectively slide through (e.g., extend from) intermediate opening 138 (FIG. 3) without moving or affecting the position of second sliding segment 214.

As shown, first and second sliding segment 212, 214 may be spaced apart from each other along the lateral direction L. In some such embodiments, a middle sliding segment 216 is positioned between first sliding segment 212 and second sliding segment 214 along the lateral direction L.

Each of the sliding segments 212, 214, 216 may include a discrete portion of forward panel 210 attached thereto. In turn, forward panel 210 may be formed of multiple discrete and separable panel members 244, 246, 248. As illustrated, the separable panel members 244, 246, 248 of forward panel 210 extend across and move with their corresponding sliding segments 212, 214, 216. Thus, a first panel member 244 is attached to first sliding segment 212 to move therewith; a second panel member 246 is attached to second sliding segment 214 to move therewith; and a middle panel member 248 is attached to middle sliding segment 216 to move therewith.

Figure 7:
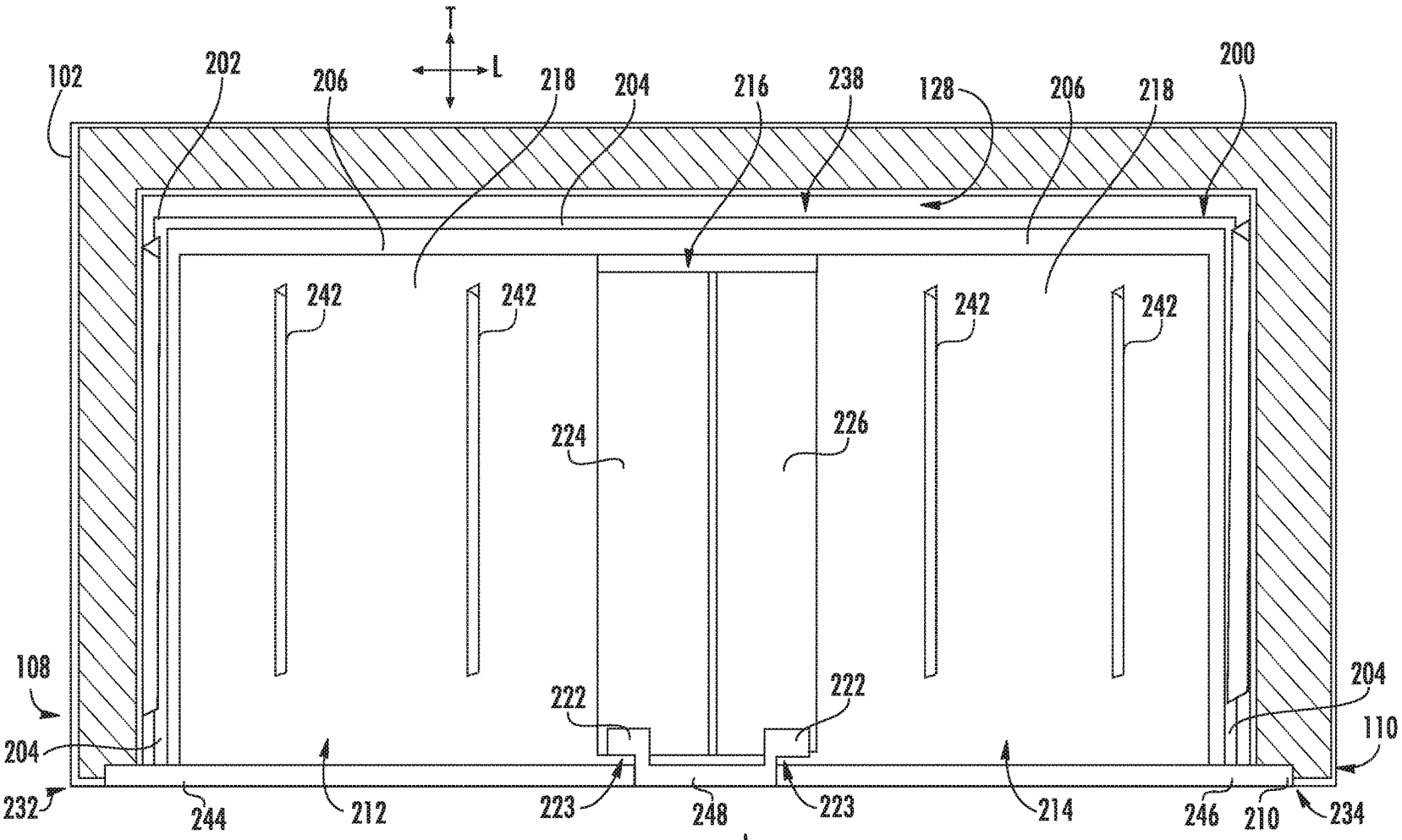
FIG. 7 provides a bottom plan view of the exemplary drawer assembly of a refrigerator appliance according to exemplary embodiments of the present disclosure.

As illustrated in FIG. 7, middle sliding segment 216 may include a lateral catch 222. Lateral catch 222 may generally extend along the lateral direction L from middle sliding segment 216 behind forward panel 210 (e.g., relative to the transverse direction T). In certain embodiments, lateral catch 222 extends along the lateral direction L from middle panel member 248 toward the first lateral side 232 and/or the second lateral side 234 (e.g., from opposite lateral ends of middle panel member 248). In some such embodiments, middle panel member 248 and lateral catch 222 define a pair of pockets 223 to receive a portion of first panel member 244 and second panel member, respectively. Optionally, a forward extreme of forward panel 210 (e.g., along the transverse direction T) may be flush across the panel members 244, 246, 248 from the first lateral side 232 to the second lateral side 234 (e.g., when each of the panel members 244, 246 are received within respective pockets 223).

Although shown as extending from middle panel member 248, alternative embodiments may provide lateral catch 222 at another suitable location on intermediate drawer 200 (e.g., mounted to a bottom surface of middle sliding segment 216).

During use, lateral catch 222 may selectively engage first and second sliding segments 212, 214 (e.g., at the forward panel 210 members 244 and 246, respectively) as middle sliding segment 216 is moved forward along the transverse direction T. For example, moving lateral catch 222 forward away from cabinet 102 may pull the entire drawer frame 202 forward (e.g., along one or more lateral slide rails mounted to opposite side walls 204) along the transverse direction T out of intermediate chamber 128. Additionally or alternatively, moving middle sliding segment 216 toward cabinet 102 may push the entire drawer frame 202 rearward along the transverse direction T into intermediate chamber 128. Thus, lateral catch 222 may advantageously ensure synchronized movement of the sliding segments 212, 214 when middle sliding segment 216 is moved forward and/or rearward, while otherwise permitting independent transverse movement of the sliding segments 212, 214.

Additionally or alternatively, as shown in FIGS. 4 through 7, one or more partitions 224, 226 may be selectively positioned between one or more of the segments 212, 214, 216 (e.g., in the lateral direction L). For example, when positioned between two sliding segments (e.g., between middle sliding segment 216 and first sliding segment 212) a partition 224 may generally extend in the vertical direction V from base panel 206 and along the transverse direction T from a rearmost side panel 204 along the transverse direction T. Thus, each partition 224, 226 may serve to separate or isolate two portions of storage volume 208. Moreover, a partition 224, 226 may advantageously hold items within one or more sliding segments (e.g., middle sliding segment 216 and/or first sliding segment 212) as another sliding segment (e.g., second sliding segment 214) is moved relative thereto.

In optional embodiments, each partition 224, 226 may be pivotally mounted to a sliding segment 212, 214, or 216 (e.g., at base panel 206 or secondary floor 218). For instance a first partition 224 and a second partition 226 may be pivotally mounted to middle sliding segment 216 to selectively separate the first sliding segment 212 and the second sliding segment 214, respectively. The first and second partitions 224, 226 may selectively pivot or fold (e.g., about a partition axis parallel to the transverse direction T) between a flat non-separating position (FIG. 4) and an upright separating position (FIGS. 5 and 6).

Figure 8:
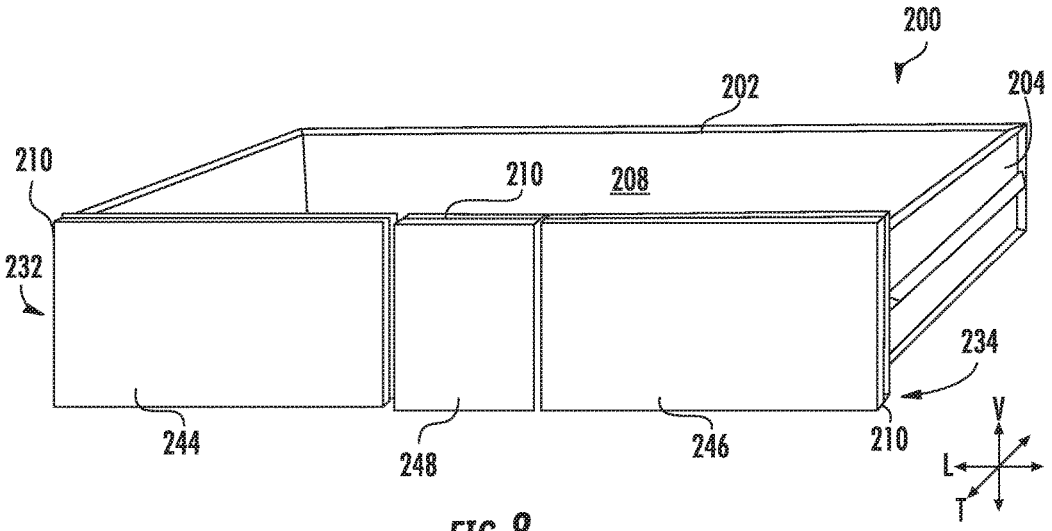
FIG. 8 provides a perspective view of an intermediate drawer of a refrigerator appliance according to exemplary embodiments of the present disclosure.
Figure 9:
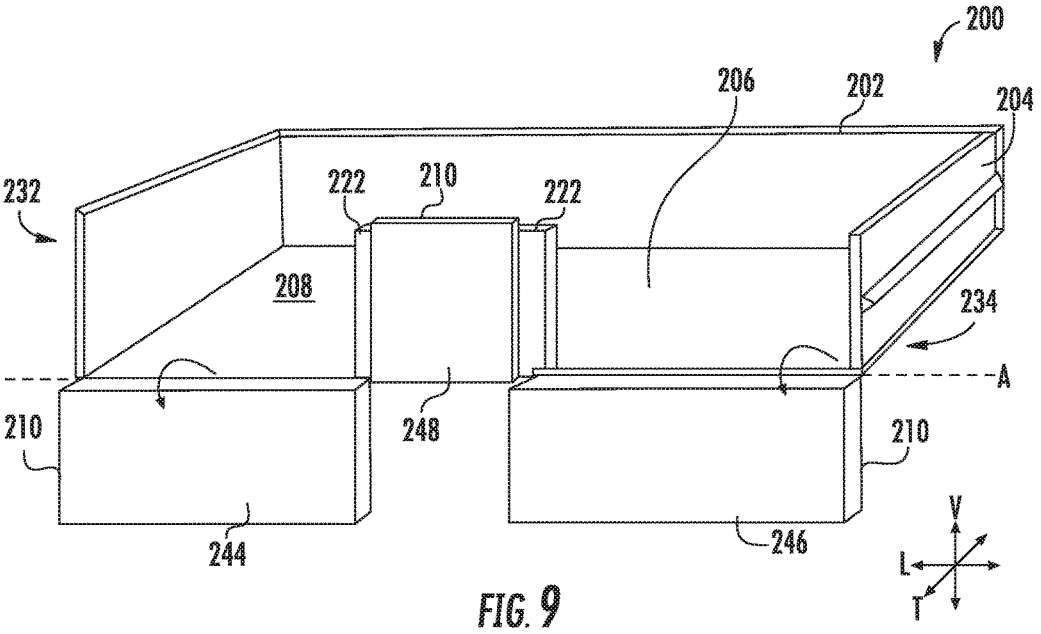
FIG. 9 provides a perspective view of the exemplary intermediate drawer of FIG. 8 with a multiple panels pivoted forward.

Turning now to FIGS. 8 and 9, further exemplary embodiments of drawer 200 are illustrated. It is understood that, the embodiments of FIGS. 8 and 9 may be generally similar to the embodiments described above with respect to FIGS. 1 through 7. Specifically, the embodiments of FIGS. 8 and 9 may include one or all of the above-described features of the embodiments of FIGS. 1 through 7, except as otherwise indicated.

As illustrated, in some embodiments, one or more portions of forward panel 210 are pivotably mounted on drawer frame 202. Specifically, one or more panel members (e.g., first panel member 244 and/or second panel member 246) of forward panel 210 may be pivotable about a pivot axis A. As shown, pivot axis A may be parallel to the lateral direction L such that pivotable panel members 244, 246 of forward panel 210 may be selectively and independently pivoted between an upright position (FIG. 8) restricting transverse access to storage volume 208 and a lowered position (FIG. 9) permitting greater access to storage volume 208.

Figure 10:
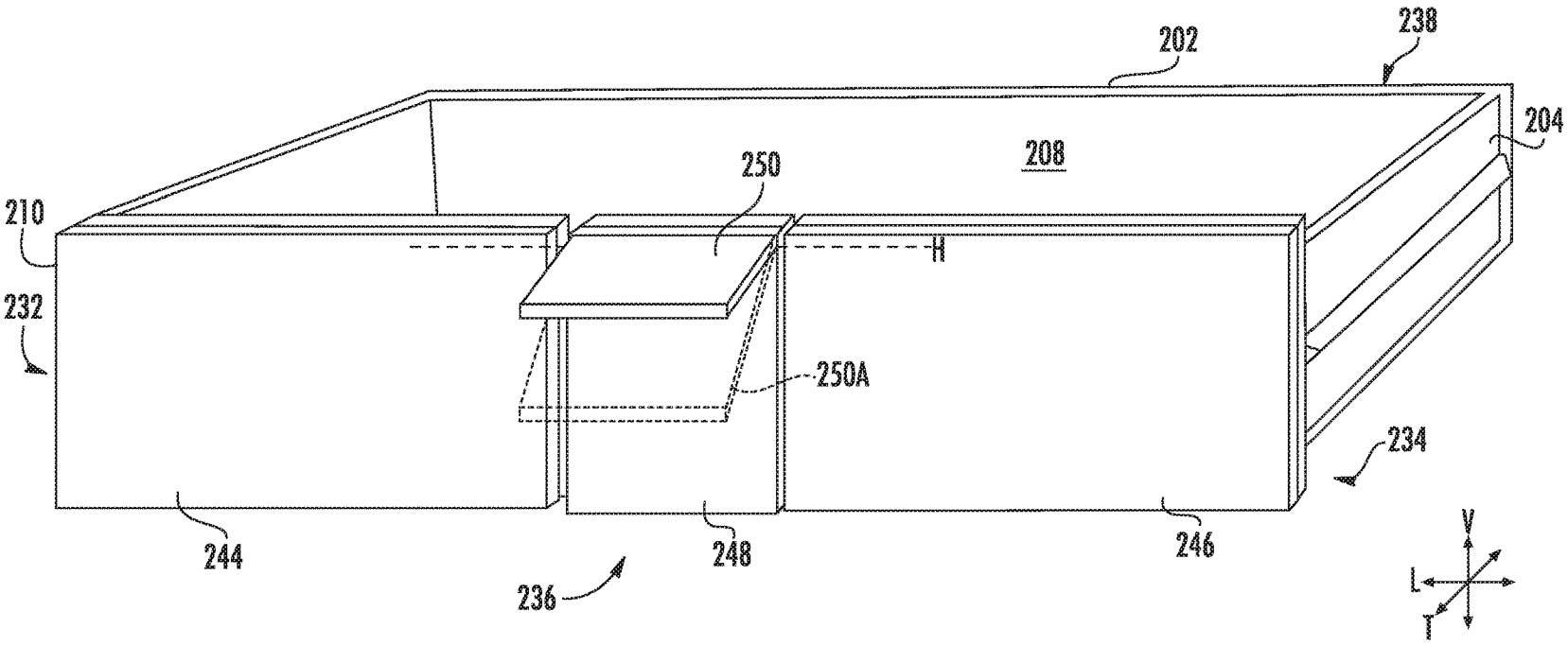
FIG. 10 provides a perspective view of an intermediate drawer of a refrigerator appliance according to exemplary embodiments of the present disclosure.
Figure 11:
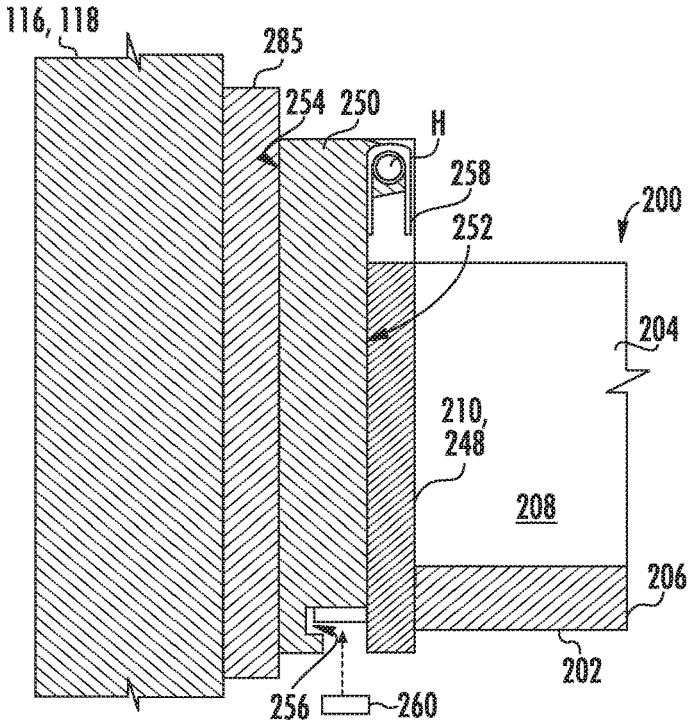
FIG. 11 provides a cross-sectional side view of a portion of the exemplary intermediate drawer of FIG. 10 with a handle pivoted rearward in a push position.
Figure 12:
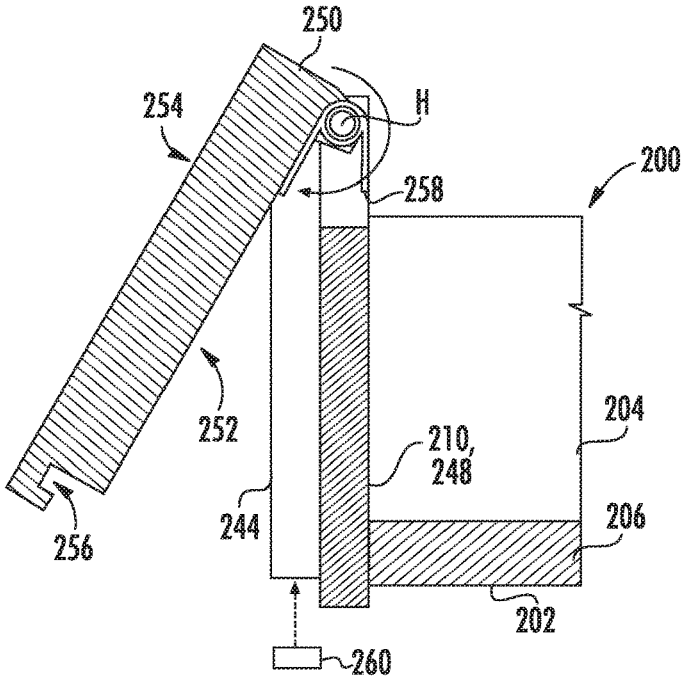
FIG. 12 provides a cross-sectional side view of a portion of the exemplary intermediate drawer of FIG. 10 with a handle pivoted forward in a pull position.

Turning now to FIGS. 10 through 12, yet further exemplary embodiments of drawer 200 are illustrated. It is understood that, the embodiments of FIGS. 10 through 12 may be generally similar to the embodiments described above with respect to FIGS. 1 through 9. Specifically, the embodiments of FIGS. 10 through 12 may include one or all of the above-described features of the embodiments of FIGS. 1 through 9, except as otherwise indicated.

As illustrated, some embodiments include a pivotable handle 250 attached to forward panel 210. For example, a pivotable handle 250 may be rotatably mounted on middle panel member 248 as a portion of forward panel 210. When assembled, pivotable handle 250 may be rotatable to pivot about a handle axis H defined on middle panel member 248 (e.g., parallel to the lateral direction L). In turn, pivotable handle 250 may rotate between a presented position (FIGS. 10 and 12) and a withdrawn position (FIG. 11). As illustrated by the dashed outline of the pivotable handle 250A in FIG. 10, the pivotable handle 250 may reach one or more intermediate positions as it rotates between the presented position and the withdrawn position.

In the withdrawn position of some embodiments, pivotable handle 250 is rotated rearward, as shown in FIG. 11. Moreover, pivotable handle 250 is held against middle panel member 248. In particular a rear face 252 of pivotable handle 250 may be positioned against or on a forward face 255 of middle panel member 248 while an opposite front face 254 of pivotable handle 250 is directed away from storage volume 208. In some such embodiments, the front face 254 may be flush with the adjacent portions of front panel 210 (e.g., panel members 244 and 246). Thus, in the withdrawn position a substantially continuous surface may be formed across front panel 210 from the first lateral side 232 to the second lateral side 234

When a door of the refrigerator appliance 100 (e.g., one or both of doors 116, 118) is provided at the closed position, a portion of the door 116 or 118 (e.g., a vertical gasket segment 285) may engage the front face 254, advantageously holding pivotable handle 250 in the withdrawn position. A notched grip 256 may be defined on a lower end of pivotable handle 250 (e.g., opposite handle axis H along the vertical direction V). In the withdrawn position, notched grip 256 may generally face middle panel member 248 and/or storage volume 208. In some such embodiments, notched grip 256 may be spaced apart from middle panel member 248 along the transverse direction T.

In the presented position, pivotable handle 250 may be generally rotated forward, as shown in FIG. 12. At least a portion of pivotable handle 250 may be positioned apart from middle panel member 248. In particular, some or all of rear face 252 of pivotable handle 250 may be spaced apart from the forward face 255 of middle panel member 248 (e.g., along an angle greater than 0° and/or less than 90° about the handle axis H). Optionally, a spring 258 (e.g., a rotatable torsion spring, compression coil spring, leaf spring, etc.) may be attached to the forward panel 210 in biased engagement with pivotable handle 250. Thus, spring 258 may urge pivotable handle 250 forward toward the presented position (e.g., at the open position of one or both of doors 116, 118—FIG. 11). Advantageously, pivotable handle 250 may be rotated to the presented position as both doors 116 and 118 are opened, intuitively inviting a user's attention and indicating that the entire drawer frame 202 may be moved forward.

In some embodiments, a light assembly 260 may be positioned adjacent to drawer 200. For example, light assembly 260 may be mounted below drawer 200 (e.g., in fixed attachment with mullion 160—FIG. 3). Light assembly 260 generally includes one or more light sources (e.g., light emitting diodes) for generating light emissions therefrom. Optionally, light assembly 260 may be vertically aligned with the forward panel 210 and/or pivotable handle 250 (e.g., in the covered position of drawer 200). Additionally, light assembly 260 may be directed toward pivotable handle 250 to transmit light emissions thereto (e.g., as directed by controller 152—FIG. 1—electrically coupled thereto). As illustrated, light assembly 260 may selectively illuminate, for example, pivotable handle 250 in the presented position.

Figure 13:
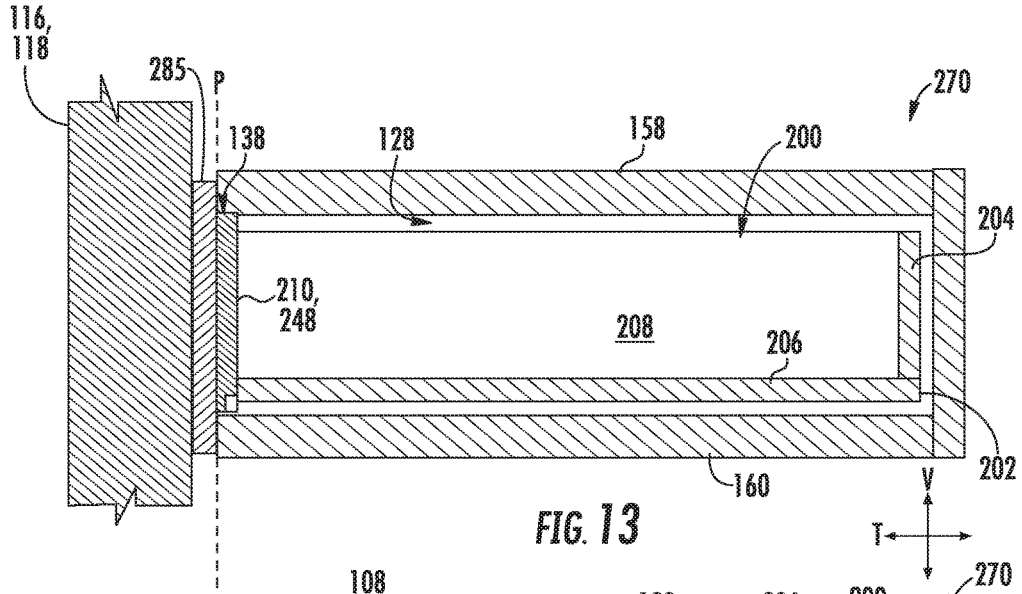
FIG. 13 provides a cross-sectional side view of a drawer assembly according to exemplary embodiments of the present disclosure.
Figure 14:
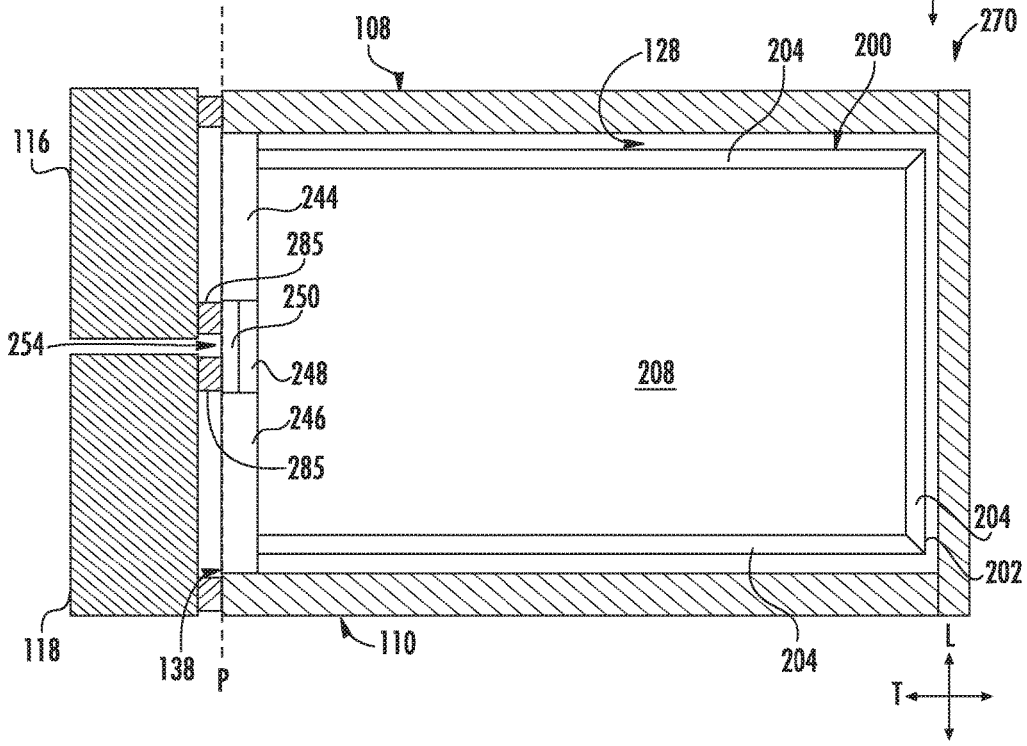
FIG. 14 provides a cross-sectional top view of the exemplary drawer assembly of FIG. 13.

Turning now to FIGS. 13 and 14, various cross-sectional views of an exemplary drawer assembly 272 in a covered position within intermediate chamber 128 are provided. It is understood that intermediate drawer assembly 270 may be generally embodied as intermediate drawer assembly 170 (FIGS. 2 and 3), or as an alternative thereto. It is further understood that, the embodiments of FIGS. 13 and 14 may include an intermediate drawer 200 that has one or more of the features described above with respect to FIGS. 4 through 12, except as otherwise indicated.

As shown, at least a portion of drawer 200 may be positioned flush with a transverse extreme of the opening 138 when drawer 200 is in the covered position. For instance, a front surface of forward panel 210 may extend along a plane P parallel to an outermost forward portion of cabinet 102. In some such embodiments, forward panel 210 extends fully across opening 138 along the vertical direction V. When drawer 200 is in the covered position forward panel 210 may form a continuous surface from upper mullion 158 to lower mullion 160. In some such embodiments, a vertical gasket segment 285 (e.g., vertically-extending segment of gasket 182 or 184—FIGS. 2 and 3) of door 116 or 118 sealingly engages with forward panel 210 in the closed position of one or both of doors 116, 118. Thus, vertical gasket segment 285 may form an uninterrupted fluid seal across opening 138 from upper mullion 158 to lower mullion 160. In particular, vertical gasket segment 285 may engage (e.g., directly or directly) middle panel member 248 and advantageously form a seal thereacross. In some such embodiments, vertical gasket segment 285 may contact the front face 254 of pivotable handle 250, holding handle 250 in the withdrawn position as vertical gasket segment 285 is sealed against the front face 254, as described above.

As shown, in particular in FIG. 14, embodiments with two discrete doors 116, 118 may each include a separate vertical gasket segment 285. In turn, when both doors 116, 118 are in the closed position, two discrete vertical seals are formed across forward panel 210 (e.g., at middle panel member 248). Thus, forward panel 210 may be sealingly engaged with vertical gasket segment 285 of a first door 116 at the closed position of the first door 116, as well as sealingly engaged with the vertical gasket segment 285 of a second door 118 at the closed position of the second door 118. Advantageously, the sealed engagement between doors 116, 118 and forward panel 210 may thermally and/or fluidly isolate intermediate chamber 128 from the ambient environment, as well as adjacent chambers (e.g., chamber 120, 122, 124, and/or 126—FIG. 3).

Figure 15:
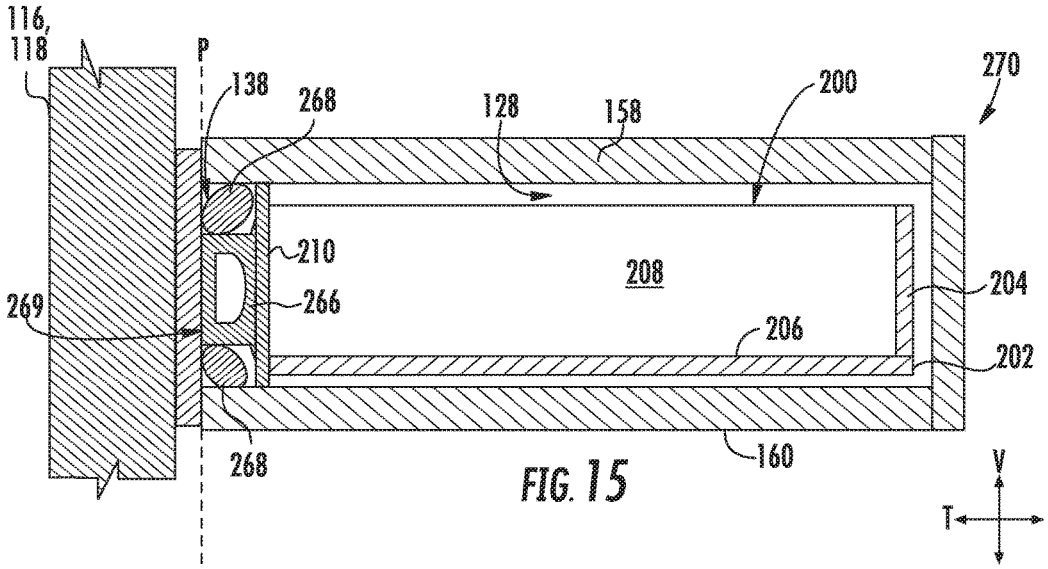
FIG. 15 provides a cross-sectional side view of a drawer assembly according to exemplary embodiments of the present disclosure.
Figure 16:
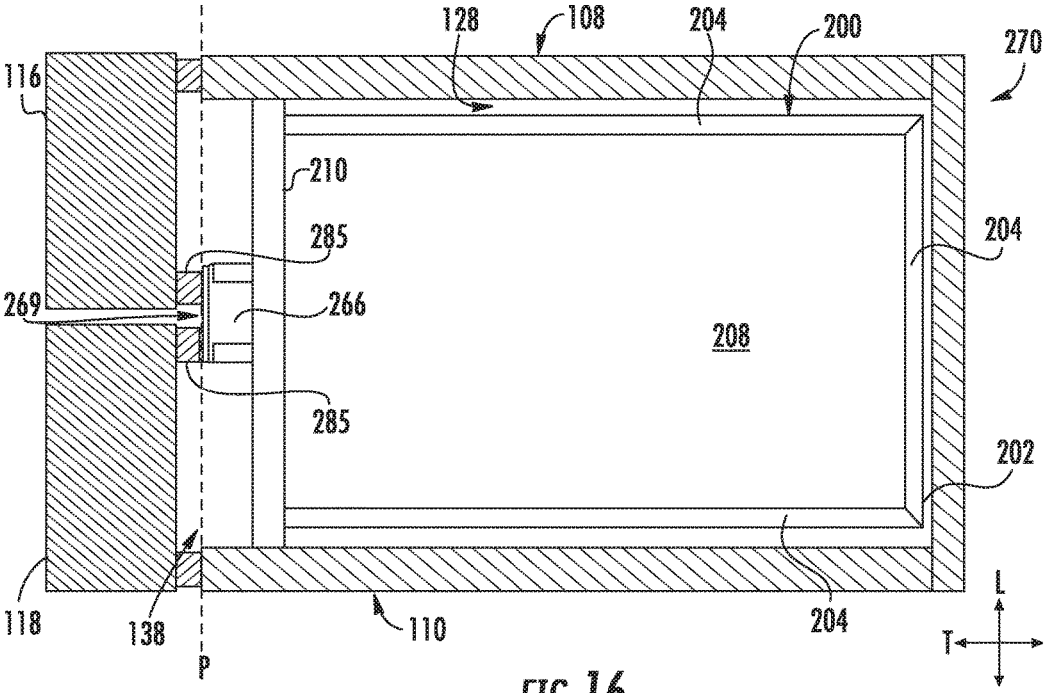
FIG. 16 provides a cross-sectional top view of the exemplary drawer assembly of FIG. 15.

Turning now to FIGS. 15 and 16, various cross-sectional views of an exemplary drawer assembly 270 in a covered position within intermediate chamber 128 are provided. It is understood that intermediate drawer assembly 272 may be generally embodied as intermediate drawer assembly 170 (FIGS. 2 and 3), or as an alternative thereto. It is further understood that, the embodiments of FIGS. 15 and 16 may include an intermediate drawer 200, as described above with respect to FIGS. 4 through 12, except as otherwise indicated.

As shown, at least a portion of drawer 200 may be positioned flush with a transverse extreme of the opening 138 when drawer 200 is in the covered position. For instance, an extended handle 266 of forward panel 210 may be fixed thereto. A front surface 269 of handle 266 may extend along a plane P parallel to an outermost forward portion of cabinet 102. In some such embodiments, extended handle 266 extends across opening 138 along the vertical direction V. A vertical gasket segment 285 (e.g., vertically-extending segment of gasket 182 or 184—FIGS. 2 and 3) of a door 116 or 118 sealingly engages with forward panel 210 in the covered position of the door 116 or 118. Thus, vertical gasket segment 285 may form an uninterrupted fluid seal across opening 138 from upper mullion 158 to lower mullion 160. In particular, vertical gasket segment 285 may engage (e.g., directly or directly) extended handle 266 and advantageously form a seal thereacross. In some such embodiments, vertical gasket segment 285 may contact front surface 269 of extended handle 266. In optional embodiments, one or more handle gaskets 271 may be positioned between extended handle 266 and the mullions 158 and/or 160 along the vertical direction V. Thus, vertical gasket segment 285 may further engage (e.g., directly or directly) gasket(s) 271 and form a seal thereacross with extended handle 266.

As shown, in particular in FIG. 16, embodiments with two discrete doors 116, 118 may each include a separate vertical gasket segment 285. In turn, when both doors 116, 118 are in the closed position, two discrete vertical seals are formed across forward panel 210 (e.g., at extended handle 266). Thus, forward panel 210 may be sealingly engaged with vertical gasket segment 285 of a first door 116 at the closed position of the first door 116, as well as sealingly engaged with the vertical gasket segment 285 of a second door 118 at the closed position of the second door 118. Advantageously, the sealed engagement between doors 116, 118 and forward panel 210 may thermally and/or fluidly isolate intermediate chamber 128 from the ambient environment, as well as adjacent chambers (e.g., chamber 120, 122, 124, and/or 126—FIG. 3).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a transverse direction, and a lateral direction for a mutually orthogonal direction system, the refrigerator appliance comprising:

a cabinet defining a chilled chamber extending along the lateral direction between a first side portion and a second side portion;

a door attached to the cabinet movable between a closed position restricting access the chilled chamber and an open position permitting access to the chilled chamber;

an upper mullion extending above the chilled chamber;

a lower mullion extending below the chilled chamber; and a drawer assembly disposed within the chilled chamber, the drawer assembly comprising a drawer frame slidable along the transverse direction, the drawer frame extending in the lateral direction between a first lateral side and a second lateral side, the drawer frame extending along the transverse direction between a front side and a rear side, a forward panel attached to the drawer frame at the front side, the forward panel extending along the lateral direction between the first lateral side and the second lateral side, the forward panel further extending along the vertical direction between the upper mullion and the lower mullion, a first sliding segment attached to the drawer frame proximal to the first lateral side, the first sliding segment being independently slidable relative to the drawer frame along the transverse direction, and a second sliding segment attached to the drawer frame proximal to the second lateral side, the second sliding segment being independently slidable relative to the drawer frame and the first sliding segment along the transverse direction, wherein the door comprises a vertical gasket segment extending between the upper mullion and the lower mullion and sealingly engaged with the forward panel to form a seal from the upper mullion to the lower mullion in the closed position of the door.

2. The refrigerator appliance of claim 1, wherein the door is a first door rotatably attached to the cabinet at the first side portion and movable between a closed position restricting access to a first portion of the chilled chamber and an open position permitting access to the first portion of the chilled chamber, and wherein the refrigerator appliance further comprises a second door rotatably attached to the cabinet at the second side portion and movable between a closed position restricting access to a second portion of the chilled chamber and an open position permitting access to the second portion of the chilled chamber.

3. The refrigerator appliance of claim 1, wherein the drawer assembly further comprises a middle sliding segment positioned between the first and second sliding segments along the lateral direction, wherein the middle sliding segment comprises a lateral catch selectively engaged with the first and second sliding segments in synchronized movement along the transverse direction.

4. The refrigerator appliance of claim 1, wherein the drawer assembly further comprises a partition selectively positioned between the first sliding segment and the second sliding segment.

5. The refrigerator appliance of claim 4, wherein the partition is pivotally mounted to the drawer frame.

6. The refrigerator appliance of claim 1, wherein the drawer assembly further comprises a pivotable handle attached to the forward panel and rotatable about a handle axis defined thereon.

7. The refrigerator appliance of claim 6, wherein the drawer assembly further comprises a middle sliding segment positioned between the first and second sliding segments along the lateral direction, wherein the middle sliding segment comprises a lateral catch selectively engaged with the first and second sliding segments in synchronized movement along the transverse direction, and wherein the pivotable handle is rotatably mounted to the middle sliding segment.

8. The refrigerator appliance of claim 7, wherein the drawer assembly further comprises a spring attached to the forward panel in biased engagement to urge the pivotable handle forward at the open position of the door.

9. The refrigerator appliance of claim 1, wherein the chilled chamber is a full-length chamber, and wherein the cabinet further defines a plurality of operably-independent chilled chambers spaced apart from the full-length chamber along the vertical direction, the plurality of operably-independent chilled chambers comprising a first chilled chamber proximal to the first side portion, and a second chilled chamber proximal to the second side portion.

10. A refrigerator appliance defining a vertical direction, a transverse direction, and a lateral direction for a mutually orthogonal direction system, the refrigerator appliance comprising:

a cabinet defining a chilled chamber, the chilled chamber extending along the lateral direction between a first side portion and a second side portion, the chilled chamber extending along the vertical direction between an upper portion and a bottom portion;

a first door rotatably attached to the cabinet at the first side portion and movable between a closed position restricting access to a first portion of the chilled chamber and an open position permitting access to the first portion of the chilled chamber, the first door including a vertical gasket segment;

a second door rotatably attached to the cabinet at the second side portion and movable between a closed position restricting access to a second portion of the chilled chamber and an open position permitting access to the second portion of the chilled chamber, the second door including a vertical gasket segment;

an upper mullion extending above the chilled chamber, the upper mullion defining the upper portion;

a lower mullion extending below the chilled chamber, the lower mullion defining the bottom portion; and a drawer assembly disposed within the chilled chamber, the drawer assembly comprising a drawer frame slidable along the transverse direction, the drawer frame extending in the lateral direction between the first portion of the chilled chamber to the second portion of the chilled chamber, the drawer frame extending along the transverse direction between a front side and a rear side, and a forward panel attached to the drawer frame at the front side and extending along the vertical direction between the upper portion and the bottom portion, the forward panel being sealingly engaged with the vertical gasket segment of the first door at the closed position of the first door and forming a seal from the upper mullion to the lower mullion, and the forward panel being sealingly engaged with the vertical gasket segment of the second door at the closed position of the second door and forming a seal from the upper mullion to the lower mullion.

11. The refrigerator appliance of claim 10, wherein the drawer assembly further comprises a first sliding segment proximal to the first side portion, the first sliding segment being independently slidable relative to the drawer frame along the transverse direction, and a second sliding segment proximal to the second side portion, the second sliding segment independently slidable relative to the drawer frame and the first sliding segment along the transverse direction.

12. The refrigerator appliance of claim 11, wherein the drawer assembly further comprises a middle sliding segment positioned between the first and second sliding segments along the lateral direction, wherein the middle sliding segment comprises a lateral catch selectively engaged with the first and second sliding segments in synchronized movement along the transverse direction.

13. The refrigerator appliance of claim 10, wherein the drawer assembly further comprises a partition selectively positioned between the first sliding segment and the second sliding segment.

14. The refrigerator appliance of claim 13, wherein the partition is pivotally mounted to the drawer frame.

15. The refrigerator appliance of claim 10, wherein the drawer assembly further comprises a pivotable handle attached to the forward panel and rotatable about a handle axis defined thereon.

16. The refrigerator appliance of claim 15, wherein the drawer assembly further comprises a middle sliding segment positioned between the first and second sliding segments along the lateral direction, wherein the middle sliding segment comprises a lateral catch selectively engaged with the first and second sliding segments in synchronized movement along the transverse direction, and wherein the pivotable handle is rotatably mounted to the middle sliding segment.

17. The refrigerator appliance of claim 16, wherein the drawer assembly further comprises a spring attached to the forward panel in biased engagement to urge the pivotable handle forward at the open position of the first door and the open position of the second door.

18. The refrigerator appliance of claim 10, wherein the chilled chamber is a full-length chamber, and wherein the cabinet further defines a plurality of operably-independent chilled chambers spaced apart from the full-length chamber along the vertical direction, the plurality of operably-independent chilled chambers comprising a first chilled chamber proximal to the first side portion, and a second chilled chamber proximal to the second side portion.

19. The refrigerator appliance of claim 10, wherein the forward panel comprises a first panel member proximal to the first side portion and pivotable about a pivot axis parallel to the lateral direction, and a second panel member proximal to the second side portion and pivotable about the pivot axis parallel to the lateral direction.

* * * * *